US007331117B2

(12) United States Patent
Lau et al.

(10) Patent No.: US 7,331,117 B2
(45) Date of Patent: Feb. 19, 2008

(54) CALCANEAL BISECTOR

(75) Inventors: Chun-Pong Lau, Kowloon (HK); Kam-Lun Leung, Kowloon (HK)

(73) Assignee: The Hong Kong Polytechnic University, Hong Kong SAR (CN)

( * ) Notice: Subject to any disclaimer, the term of this patent is extended or adjusted under 35 U.S.C. 154(b) by 427 days.

(21) Appl. No.: 10/898,553

(22) Filed: Jul. 26, 2004

(65) Prior Publication Data

US 2006/0016028 A1 Jan. 26, 2006

(51) Int. Cl.
*A43D 1/00* (2006.01)

(52) U.S. Cl. ..... 33/670; 33/515; 33/3 R; 33/3 A

(58) Field of Classification Search ..... 33/549, 33/552, 554–555, 511–512, 515, 3 A, 3 R, 33/3 B, 670
See application file for complete search history.

(56) References Cited

U.S. PATENT DOCUMENTS 2,347,958 A * 5/1944 McGrew ..... 33/21.1
3,786,567 A * 1/1974 Dangay et al. ..... 33/23.02
3,988,834 A * 11/1976 Anderson ..... 33/21.1
5,088,504 A * 2/1992 Benesh et al. ..... 33/515
5,984,931 A * 11/1999 Greenfield ..... 33/515
6,163,971 A * 12/2000 Humphries et al. ..... 33/515
6,578,276 B2 * 6/2003 Patton et al. ..... 33/18.1
6,983,548 B1 * 1/2006 Cook et al. ..... 33/515

* cited by examiner

*Primary Examiner*—Yaritza Guadalupe-McCall
(74) *Attorney, Agent, or Firm*—Jacobson Holman PLLC

(57) ABSTRACT

A calcaneal bisector for indicating a calcaneal bisection line of a heel firstly includes a frame and a first plate mounted relative to the frame. One side of the heel can be aligned to the first plate when the bisector is in use. The bisector also includes a second plate movably mounted to the frame, and the second plate is slidable relative to the first plate for aligning to the other side of the heel. The bisector further includes an indicator movably mounted relative to the frame for indicating the calcaneal bisection line and a transmission mechanism disposed between the plates and the indicator for correlating movements of the indicator and the relative movements of the plates so as to ascertain the calcaneal bisection line.

12 Claims, 3 Drawing Sheets

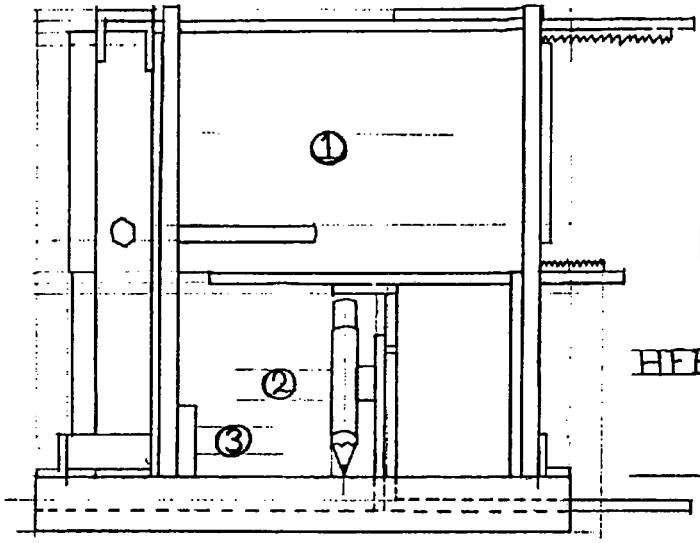
Figure 3A
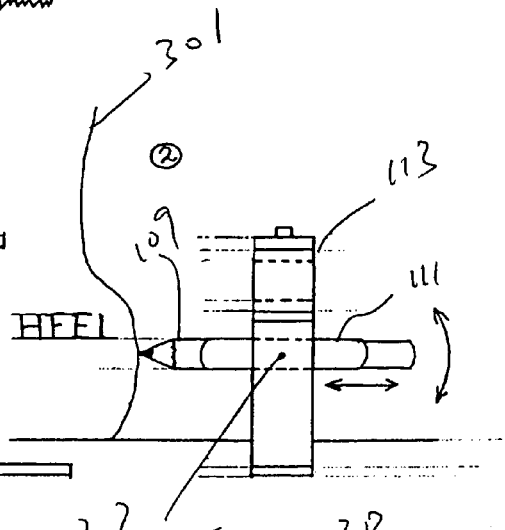
Figure 3B
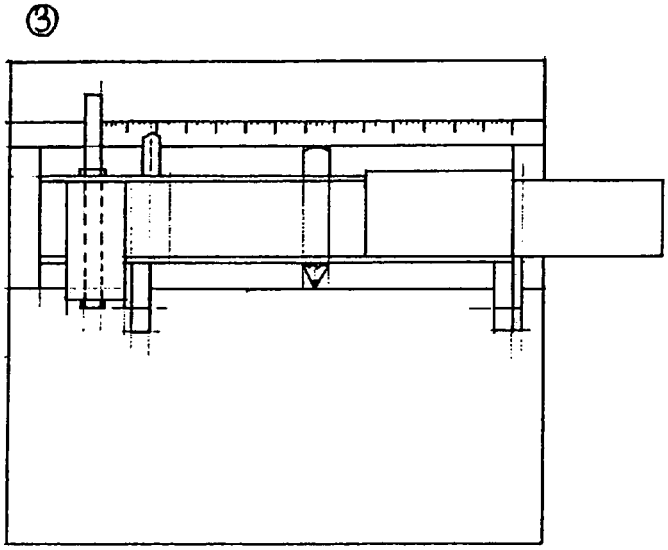

CALCANEAL BISECTOR

BACKGROUND

1. Field of the Invention

The present invention relates to technologies for indicating a calcaneal bisection line of a heel.

2. Background of the Invention

In clinical practice of foot orthotics, a calcaneal bisection line of the posterior heel surface is commonly used as the reference for orthotic designs. Conventionally, a caliper and a ruler are used to mark two mid points at two separate levels on the heel, and a bisection line can be drawn by joining these two points together. Obviously low reliability may exist with this conventional method.

OBJECT OF THE INVENTION

Therefore, it is an object of the present invention to provide an apparatus for indicating the calcaneal bisection line of the heel more accurately and conveniently, or at least provide the public with a useful choice.

SUMMARY OF THE INVENTION

According to an aspect of the present invention, a calcaneal bisector for indicating a calcaneal bisection line of a heel firstly includes a frame and a first plate mounted relative to the frame. One side of the heel can be aligned to the first plate when the bisector is in use. The bisector also includes a second plate movably mounted to the frame, and the second plate is slidable relative to the first plate for aligning to the other side of the heel. The bisector further includes an indicator movably mounted relative to the frame for indicating the calcaneal bisection line and a transmission mechanism disposed between the plates and the indicator for correlating movements of the indicator and the relative movements of the plates 80 as to ascertain the calcaneal bisection line.

Other aspects and advantages of the invention will become apparent from the following detailed description, taken in conjunction with the accompanying drawings, which description illustrates by way of example the principles of the invention.

BRIEF DESCRIPTION OF THE DRAWINGS

FIG. 3A is a plan view of the bisector of FIG. 1; and

FIG. 3B is a side view showing a pen of the bisector of FIG. 1 drawing a bisection line on a heel.

DETAILED DESCRIPTION

Figure 1:
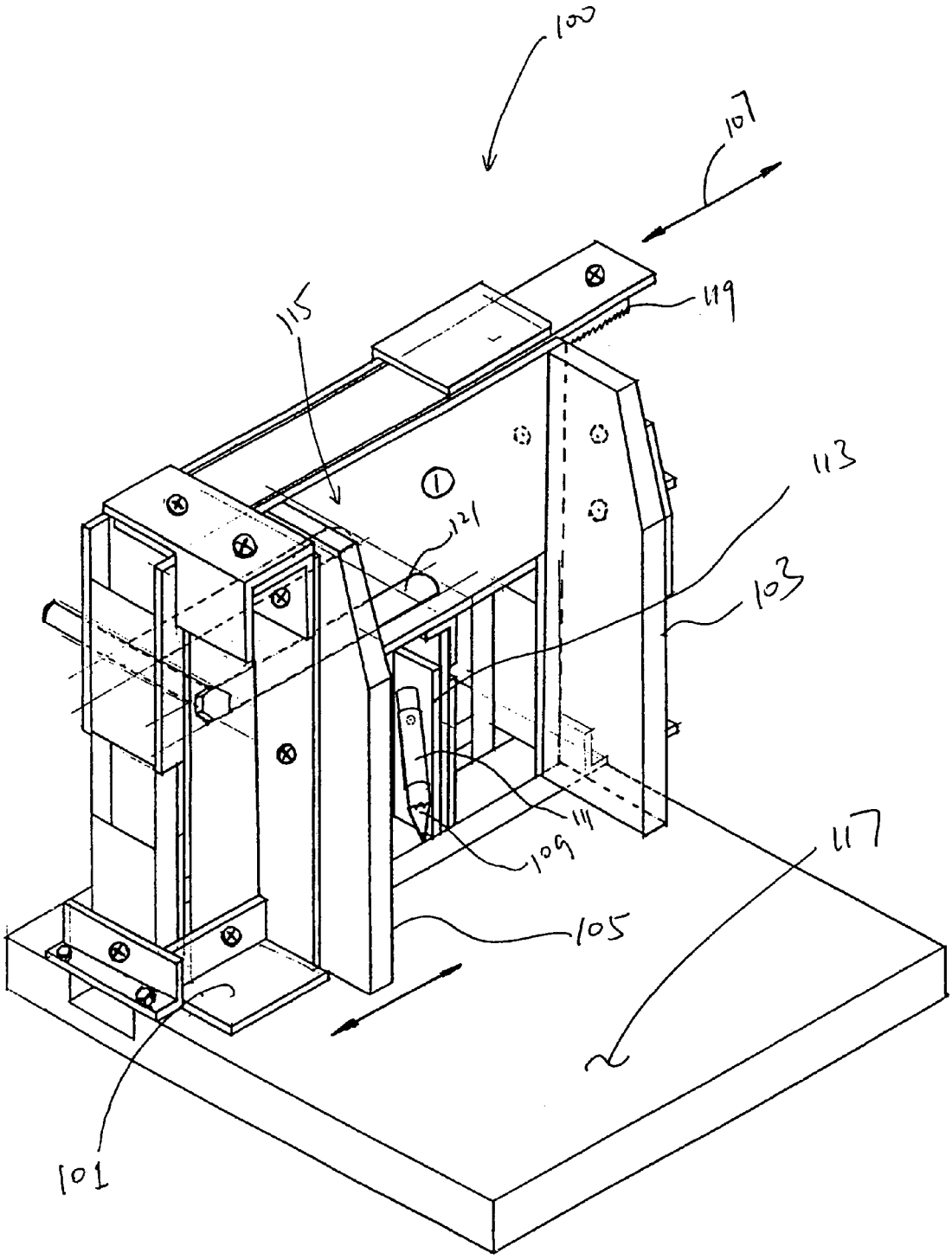
FIG. 1 is a perspective view of a calcaneal bisector in accordance with an exemplary embodiment of the present invention.

As shown in FIG. 1, a calcaneal bisector embodiment 100 of the present invention firstly includes a frame generally indicated as 101 and a pair of reference plates 103, 105 parallel to each other. One of the reference plates 103 is fixedly mounted to the frame 101. The other reference plate 105 is movably mounted to the frame 101 and may slide relative to the fixed plate 103 in a directional 107 perpendicular to the fixed reference plate 103 for clipping the heel 301 (see FIG. 3B) along its width when the bisector 100 is in use. A pen 109, which functions as an indicator to draw the bisection line on the heel in the exemplary embodiment, is slidably inserted in a longitudinal pen holder 111, which is rotatably mounted to a piece of movable pen-holder-plate 113. In the exemplary embodiment, the movements of the pen-holder-plate 113 are synchronized with the movements of the movable reference plate 105 through a transmission mechanism, which is generally indicated as 115. When the bisector 100 is in use, the foot of the user may rest atop a rest plate 117 connected to an end of the pair of the reference plates 103, 105. The movable reference plate 105 is firstly manually moved away from the fixed reference plate 103 for the heel to fit Into the bisector and then is manually moved towards the fixed reference plate 103 for clipping the heel along its width. When the movable reference plate 105 stops its movements, in the exemplary embodiment, the pen 109 points to approximately the mid point of the heel. By rotating the penholder 111, a calcaneal bisection line can be drawn on the heel.

Figure 2:
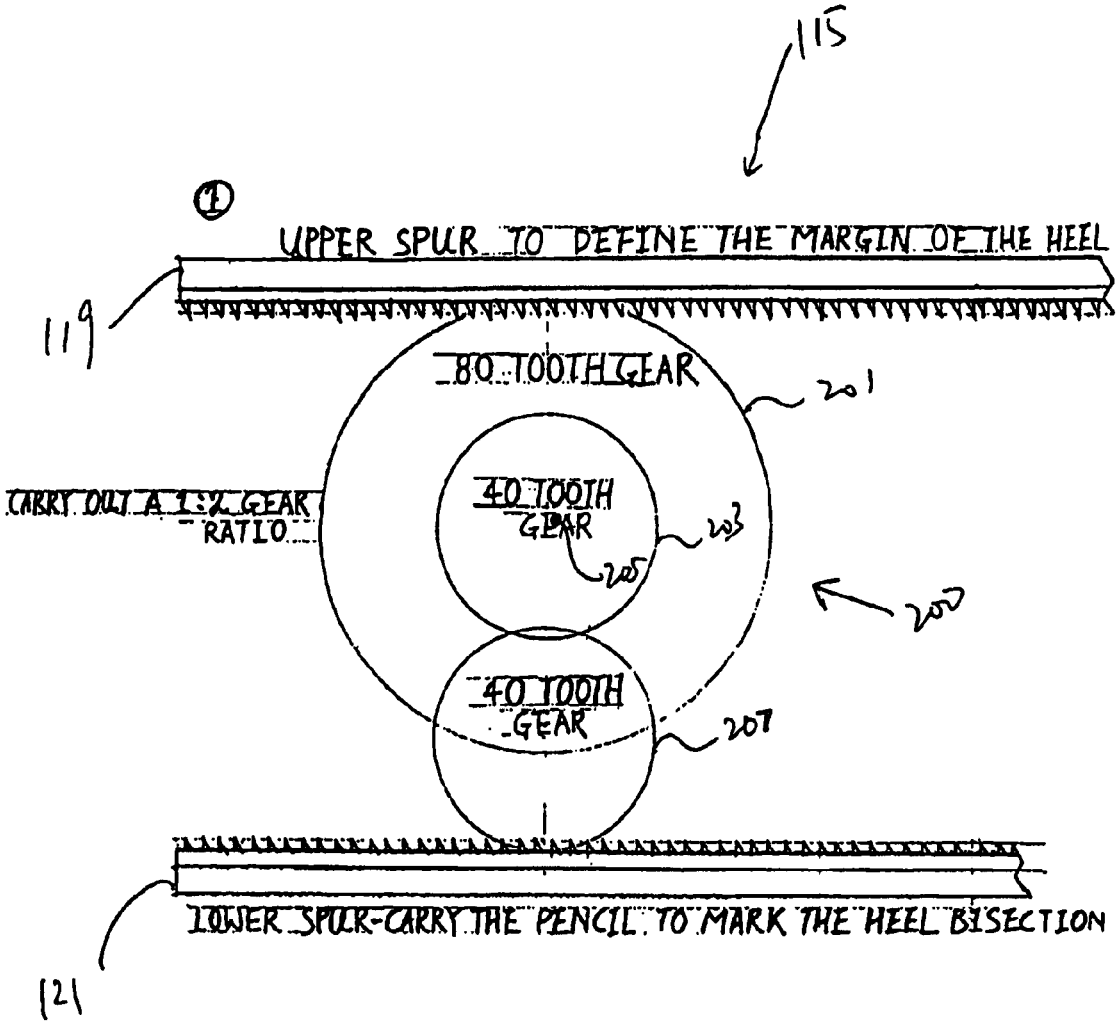
FIG. 2 is a plan view of a transmission mechanism, which can be used in the bisector of FIG. 1.

As shown in FIGS. 1 and 2, the transmission mechanism 115 has a pair of gear tracks 119, 121 parallel to each other and a gear train 200 disposed therebetween. The upper gear track 119 is connected to and moves together with the movable reference plate 105, while the lower gear track 121 is connected to and moves together with the pen-holder-plate 113. The gear train 200 has a 80-tooth gear 201 engaged with the upper gear track 119, a 40-tooth gear 203 mounted to the axle 205 of the 80-tooth gear 201 and rotating together with the 80-tooth gear 201, and another 40-tooth gear 207 engaged with both the 40-tooth gear 203 and the lower gear track 121. Through such a gear train 200 and the gear tracks 119, 121, when the movable reference plate 105 is moved manually, the pen-holder-plate 113 and consequently the penholder 111 and the pen 109 are driven to move accordingly. In the exemplary embodiment, the spacing between two adjacent teeth of the gear tracks 119, 121 and the gears 201, 203, 207 is designed to be the same. Therefore, the gear train 200 of 2:1 ratio ensures the pen-holder-plate 111, as well as the pen 109, to travel half the distance of what the movable reference plate 105 travels. In the exemplary embodiment, the pen-holder-plate 113 is configured such that the pen 109 points to the mid point between the two reference plates 103, 105 in the very beginning. With such configuration and the gear train 200 of a predetermined ratio, the pen 109 is maintained to point to the mid point between the pair of reference plates 103, 105 during the movements of the movable reference plate 105.

As shown in FIG. 3B, the penholder 111 is rotatable about an axle 303, by which it is mounted to the pen-holder plate 113. The penholder 113 can rotate in a plane parallel to the pen-holder-plate, and by rotating the penholder, the pen 109, which may slide along the penholder longitudinally in line with the profile of the heel 301, draws the calcaneal bisection line on the heel 301.

Various alternatives can be made to the exemplary embodiment as generally understood by the people in the art. For example, both plates can be movably mounted to the frame, and one of the plates can also move relative to the other. In this case, the transmission mechanism transmits the relative movements of these two plates to the indicator for ascertaining and drawing the bisection line. In addition, a pair of soft padding (not shown) can be attached to the reference plates respectively for touching two sides of heel when the bisector is in use.

What is claimed is:

1. A calcaneal bisector for indicating a calcaneal bisection line of a heel of a subject, the bisector comprising a frame;

a first plate mounted relative to the frame, wherein one side of the heel can be aligned to the first plate when the bisector is in use;

a second plate movably mounted to the frame, wherein the second plate is sildable relative to the first plate for aligning to the other side of the heel;

an indicator movably mounted relative to the frame for indicating the calcaneal bisection line; and a transmission mechanism disposed between the plates and the indicator, said transmission mechanism including a gear train of a ratio of approximately 2:1 and being arranged such that relative movements of the plates are transferred to cause movement of the indicator, wherein said first plate, second plate, indicator and transmission mechanism are arranged such that the distance traveled by the indicator is approximately half of the distance traveled by the second plate relative to the first plate; and upon placement of the heel of the subject between the first and second plates and the plates being moved towards each other so as to abut the heel of the patient, the indicator is moved by the transmission mechanism denotes to a position between the plates so as to ascertain the calcaneal bisection line.

2. The bisector of claim 1, wherein the first plate is fixedly mounted to the frame.

3. The bisector of claim 1, further comprising a pair of gear tracks, mounted to the movable plate and the indicator respectively and engaged with the gear train, for transforming the relative movements of the plates to the indicator through the gear train.

4. The bisector of claim 1, wherein the second plate is at least substantially parallel to the first plate and moves in a direction at least substantially perpendicular to the first plate.

5. The bisector of claim 1, further comprising a rest plane mounted to the frame for the heel to rest atop.

6. The bisector of claim 1, wherein the indicator includes a pen for drawing the bisection line on the heel.

7. The bisector of claim 6, further comprising a penholder mounted to the frame for holding the pen.

8. The bisector of claim 7, wherein the penholder is rotatable in a plane at least substantially parallel to the first plate for drawing the bisection line.

9. The bisector of claim 6, wherein the penholder is adjustable for holding the pen of different sizes.

10. The bisector of claim 1, further comprising a pair of soft padding attached to the first plate and the second plate respectively for touching the two sides of heel when the bisector is in use.

11. A method of bisecting the heel of a patient, the method comprising the steps of:

(i) providing a bisector according to claim 1;

(ii) placing the heel of a patient between the first and second plates of the bisector;

(iii) urging the plates towards each other so as to abut the heel of the patient.

12. The method according to claim 11, further comprising the step of:

(iv) marking the heel of the patient at the location of the indicator so as to provide an indication of the calcaneal bisection location.

* * * * *